United States Patent [19]

Farrier et al.

[11] Patent Number: 5,076,297

[45] Date of Patent: Dec. 31, 1991

[54] METHOD FOR PREPARING CARBON FUEL FOR SMOKING ARTICLES AND PRODUCT PRODUCED THEREBY

[75] Inventors: Ernest G. Farrier, Winston-Salem; Jackie L. White, Pfafftown, both of N.C.

[73] Assignee: R. J. Reynolds Tobacco Company, Winston-Salem, N.C.

[21] Appl. No.: 840,113

[22] Filed: Mar. 14, 1986

[51] Int. Cl.[5] ..... A24D 1/18

[52] U.S. Cl. ..... 131/369; 131/359; 44/577; 44/599; 44/DIG. 93

[58] Field of Search ..... 131/359, 369; 44/15 A, 44/15 B, 15 C, 15 D

[56] References Cited

U.S. PATENT DOCUMENTS

| | | | |
|---|---|---|---|
| 1,985,840 | 12/1934 | Sadtler . | |
| 2,907,686 | 10/1959 | Siegel | 131/359 |
| 3,545,448 | 12/1970 | Morman et al. . | |
| 3,608,560 | 9/1971 | Briskin . | |
| 3,738,384 | 6/1973 | Bennett . | |
| 3,805,803 | 4/1974 | Hedge . | |
| 3,818,915 | 6/1974 | Anderson . | |
| 3,831,609 | 8/1974 | Briskin . | |
| 3,834,398 | 9/1974 | Briskin . | |
| 3,885,574 | 5/1975 | Borthwick et al. . | |
| 3,931,824 | 1/1976 | Miano et al. . | |
| 3,943,942 | 3/1976 | Anderson . | |
| 3,993,082 | 11/1976 | Martin . | |
| 4,002,176 | 1/1977 | Anderson . | |
| 4,014,349 | 3/1977 | Morman et al. . | |
| 4,019,521 | 3/1977 | Briskin . | |
| 4,075,156 | 2/1978 | Johnson . | |
| 4,075,157 | 2/1978 | Johnson . | |
| 4,075,160 | 2/1978 | Mills et al. . | |
| 4,079,742 | 3/1978 | Ranier et al. . | |
| 4,133,317 | 1/1979 | Briskin . | |
| 4,138,471 | 2/1979 | Lamond et al. . | |
| 4,199,104 | 10/1978 | Roth . | |
| 4,219,013 | 8/1980 | Ranier . | |
| 4,244,381 | 1/1981 | Lendvay et al. . | |
| 4,256,123 | 3/1981 | Lendvay et al. . | |
| 4,286,604 | 9/1981 | Ehretsmann et al. . | |
| 4,326,544 | 4/1982 | Hardwick et al. . | |
| 4,340,072 | 7/1982 | Bolt . | |
| 4,347,855 | 9/1982 | Lanzillotti et al. . | |
| 4,391,285 | 7/1983 | Burnett et al. . | |
| 4,474,191 | 10/1984 | Steiner . | |
| 4,481,958 | 11/1984 | Ranier . | |
| 4,596,259 | 6/1986 | White et al. . | |

FOREIGN PATENT DOCUMENTS

| | | |
|---|---|---|
| 0074201 | 3/1983 | European Pat. Off. . |
| 117355 | 4/1984 | European Pat. Off. . |
| 135266 | 7/1985 | European Pat. Off. . |
| 174645 | 3/1986 | European Pat. Off. . |
| 956544 | 4/1967 | United Kingdom . |
| 1431045 | 6/1972 | United Kingdom . |

OTHER PUBLICATIONS

Ames et al., Mut. Res., 3:347-364 (1975).
Nagao et al., Mut. Res., 42:335 (1977).

*Primary Examiner*—V. Millin
*Attorney, Agent, or Firm*—Grover M. Myers; David G. Conlin

[57] ABSTRACT

The present invention is directed to methods for producing carbon containing fuel elements especially suited for use in cigarette—like smoking articles. One method of the present invention makes use of two separate pyrolysis steps to ensure that the carbon used to form the fuel elements for smoking articles is substantially free of materials which could adversely affect the aerosol delivered by such articles. Also disclosed is a method in which a fuel element formed from carbon and a binder is pyrolyzed after formation to convert the binder to carbon.

32 Claims, 1 Drawing Sheet

METHOD FOR PREPARING CARBON FUEL FOR SMOKING ARTICLES AND PRODUCT PRODUCED THEREBY

BACKGROUND OF THE INVENTION

The present invention relates to methods for preparing carbon containing fuels for smoking articles and to the fuel products produced thereby. These methods and fuels are especially useful in making cigarette—type smoking articles that produce an aerosol resembling tobacco smoke, but which contain no more than a minimal amount of incomplete combustion or pyrolysis products.

Many tobacco substitute smoking materials have been proposed through the years, especially over the last 20 to 30 years. These proposed tobacco substitutes have been prepared from a wide variety of treated and untreated materials, especially cellulose based materials. Numerous patents teach proposed tobacco substitutes made by modifying cellulosic materials, such as by oxidation, by heat treatment, or by the addition of materials to modify the properties of the cellulose. A substantial list of such substitutes is found in U.S. Pat. No. 4,079,742 to Rainer et al.

Many patents describe the preparation of proposed smoking materials from various types of carbonized (i.e., pyrolyzed) cellulosic material. These include U.S. Pat. No. 2,907,686 to Siegel, U.S. Pat. No. 3,738,374 to Bennett, U.S. Pat. Nos. 3,943,941 and 4,044,777 to Boyd et al., U.S. Pat. Nos. 4,019,521 and 4,133,317 to Briskin, U.S. Pat. No. 4,219,031 to Rainer, U.S. Pat. No. 4,286,604 to Ehretsmann et al., U.S. Pat. No. 4,326,544 to Hardwick et al., U.S. Pat. No. 4,481,958 to Rainer et al., Great Britain Patent No. 956,544 to Norton, Great Britain Patent No. 1,431,045 to Boyd et al., and European Patent Application No. 117,355 to Hearn, et al. In addition, U.S. Pat. No. 3,738,374 to Bennett teaches that tobacco substitutes may be made from carbon or graphite fibers, mat or cloth, most of which are made by the controlled pyrolysis of cellulosic materials, such as rayon yarn or cloth.

Other prior art patents describe the use of carbon or pyrolyzed cellulosic material either as a component of proposed smokable materials or as a filler for such materials. These include U.S. Pat. No. 1,985,840 to Sadtler, U.S. Pat. Nos. 3,608,560, 3,831,609, and 3,834,398 to Briskin, U.S. Pat. No. 3,805,803 to Hedge, U.S. Pat. No. 3,885,574 to Borthwick et al., U.S. Pat. No. 3,931,284 to Miano et al., U.S. Pat. No. 3,993,082 to Martin et al., U.S. Pat. No. 4,199,104 to Roth, U.S. Pat. Nos. 4,244,381 and 4,256,123 to Lendvay et al., U.S. Pat. No. 4,340,072 to Bolt, U.S. Pat. No. 4,347,855 to Lanzillotti et al., U.S. Pat. No. 4,391,285 to Burnett et al., and U.S. Pat. No. 4,474,191 to Steiner.

Still other patents describe the partial pyrolysis of cellulosic materials to prepare proposed smoking materials. These include U.S. Pat. Nos. 3,545,448 and 4,014,349 to Morman et al., U.S. Pat. Nos. 3,818,915, 3,943,942 and 4,002,176 to Anderson, and U.S. Pat. No. 4,079,742 to Rainer et al.

Despite decades of interest and effort, it is believed that none of the aforesaid smoking materials have been found to be satisfactory as a tobacco substitute. Indeed, despite extensive interest and effort, there is still no smoking article on the market which provides the benefits and advantages associated with conventional cigarette smoking, without delivering considerable quantities of incomplete combustion and pyrolysis products.

SUMMARY OF THE INVENTION

The present invention is directed to methods for preparing carbon containing fuels useful in smoking articles such as cigarette-type articles, pipes, and the like, as well as intermediate and end products made using such methods.

One method of the present invention makes use of two separate pyrolysis steps to ensure that the carbon used to form the fuel elements for smoking articles is substantially free of materials which could adversely affect the aerosol delivered by such articles. This method includes the steps of:

(a) pyrolyzing a carbon containing, preferably cellulosic, starting material at a temperature range of from about 400° C. to 1250° C., preferably at about 700° C. to 800° C., in a non-oxidizing atmosphere;

(b) cooling the pyrolyzed material in a non-oxidizing atmosphere;

(c) reducing the size of the cooled pyrolyzed material to put such material into particulate or powder form; and (d) heating the size reduced material in a non-oxidizing atmosphere at a temperature of at least 650° C. for a period sufficient to remove volatiles therefrom.

This twice pyrolyzed carbon material may then be used to fabricate carbon fuel elements useful in smoking articles.

Another method of forming carbon products useful for the formation of fuel elements for smoking articles involves two size reduction steps in combination with the intermediate formation of a coherent mass (e.g., by extrusion or by casting) from an admixture of the size reduced carbon and a binder. This assures even distribution of the binder within the carbon particles, and provides a free flowing extrusion or pressing mixture during formation of the fuel element. This method involves the steps of:

(a) reducing the size of the pyrolyzed carbon containing material (e.g., from step (a) of the process described above) to an average particle size of about 10 microns or less;

(b) admixing the particulate carbon material with sufficient binder and water to make a paste;

(c) forming the paste into a coherent mass, e.g., by casting it into a sheet, or by extruding it into a rod-like mass;

(d) drying the coherent mass;

(e) reducing the size of the dried coherent mass into coarse particles (−10 mesh); and (f) admixing the coarse particles with sufficient water to make a paste which is suitable for forming into fuel elements, e.g., by extrusion or pressure molding. The carbon/binder fuel elements prepared according to the processes of the present invention may be further pyrolyzed after formation, for example, at from about 850° C. to 950° C., for about two hours, to convert at least a portion of the binder to carbon, and to thereby form a substantially all carbon fuel element. This post-formation pyrolysis step reduces taste contributions that the binder may contribute to the mainstream aerosol.

In general, smoking articles utilizing the fuel elements prepared by the processes of the present invention include the fuel element; a physically separate aerosol generating means including an aerosol forming material, attached to one end of said fuel element; and an aerosol delivery means such as a longitudinal passageway in the form of a mouthend piece, attached to said aerosol generating means. Examples of such cigarette-type smoking articles are described in European Patent Application No. 85111467.8, filed 11 Sept. 1985, now EPO Publication No. 174,645, the disclosure of which is incorporated herein by reference.

DETAILED DESCRIPTION OF THE PREFERRED EMBODIMENTS

Figure 1:
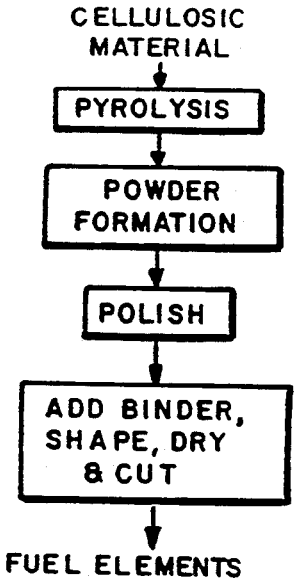
FIG. 1 is a schematic representation of the preferred processing conditions of the present invention.

The starting material for preparing the fuel elements of the present invention may be virtually any of the numerous carbon precursor sources known to those skilled in the art.

In general, the carbon containing starting material which is used to prepare the preferred fuel element should contain primarily carbon, hydrogen and oxygen. Preferred carbon containing materials are cellulosic materials, preferably those with a high (i.e., greater than about 80%) alpha-cellulose content, such as cotton, rayon, paper, and the like. One especially preferred high alpha-cellulose starting material is hardwood paper stock such as non-talc containing grades of Grande Prairie Canadian Kraft paper, obtained from Buckeye Cellulose Corp., Memphis, Tenn. Other cellulose containing materials, such as wood, tobacco, coconut, lignin, and the like, while not preferred, may be used. Likewise, other carbon containing materials, such as coal, pitch, bitumen, and the like, while not preferred, may also be used.

The first step in the process of the present invention is the pyrolysis of the starting material, preferably a cellulosic starting material, at a temperature between about 400° C. to about 1300° C., preferably between about 500° C. to about 950° C., in a non-oxidizing atmosphere, for a period of time sufficient to ensure that all of the cellulose material has reached the desired carbonization temperature. When the preferred second pyrolysis step (i.e., polishing step) is to be utilized, this initial pyrolysis step is most preferably conducted at from about 700° C. to 800° C. When no polishing step is to be conducted, the most preferred operating temperature range for this pyrolysis step is from about 750° C. to 850° C.

As used herein, the term "non-oxidizing atmosphere" is defined to include both inert atmospheres and vacuum conditions. Also included within this definition is the slightly oxidizing atmosphere created when moisture and/or other materials (such as hydrogen and hydrocarbons) are driven from the partially carbonized cellulose upon initial heating inside a furnace.

The use of an inert or non-oxidizing furnace atmosphere during the pyrolysis of carbon containing materials is desirable to maximize the yield of carbon solids, while minimizing the formation of gaseous carbons, i.e., carbon monoxide and carbon dioxide.

A totally inert or non-oxidizing atmosphere is seldom achieved because the pyrolysis products themselves are frequently mildly oxidizing.

Alternatively, the use of a vacuum or inert flushing gas such as argon or nitrogen (or a combination of vacuum and flushing gas) will provide a substantially non-oxidizing atmosphere but will also remove carbon bearing volatile pyrolysis products which in part can be made to contribute to the solid carbon yield.

In small scale production, a positive pressure of an inert gas such as nitrogen may be used to eliminate air leakage into the furnace, (and therefore prevent oxidation) and to suppress volatilization of carbon-bearing pyrolysis compounds. Maximum carbon yields are generally obtained using this technique even though the atmosphere contains some mildly oxidizing components such as water vapor.

In the large volume production of carbon from cellulosic materials, processing economies generally do not favor the use of a positive pressure of an inert gas, or a positive flow of inert gas, or a vacuum, or any combinations thereof. A small amount of loss of solid carbon product, due to the escape of carbon-bearing volatile pyrolysis products, or due to oxidation, is acceptable.

Controlled loss conditions can be achieved by placing the material to be pyrolyzed in a vented closed container, which is then placed within an appropriate furnace. The closed container is then heated through a controlled temperature profile. Preferably, the heating cycle in large volume carbon production is designed to minimize carbon loss.

For cellulosic materials, the chamber atmosphere is initially air, which is replaced by the initial pyrolysis product, water vapor. As pyrolysis continues the water vapor is diluted and replaced by carbon bearing volatiles (e.g., methane, and the like) and hydrogen. The temperature profile is controlled to assure minimum oxidation and maximum residence time for carbon bearing volatiles to maximize solid carbon yield from the volatiles.

Carbonizing furnaces are typically designed to have a minimum volume per volume of carbon, because air is drawn back into the closed container during cooling and a small amount of the solid carbon product is oxidized thereby. Such oxidation may also be minimized by use of controlled cooling. In practice many containers are placed in a large furnace and allowed to cool with the furnace thus providing a minimum cooling rate more than ample to minimize oxidation.

The overall pyrolysis time depends, at least in part, upon the nature of the materials being pyrolyzed. For example variables such as how much material is being pyrolyzed, the packing of such material within the heating means, the nature of the volatiles present, and the like, will each affect how long it takes for the temperature of the core of the material to reach the desired pyrolysis temperature.

Although the pyrolysis may be conducted at a constant temperature, it has been found that a slow pyrolysis, employing a gradually increasing heating rate, e.g., at from about 1° C. to 20° C. per hour, preferably from about 5° C. to 15° C. per hour, over many hours, produces a more uniform material and a higher carbon yield.

The pyrolysis conditions useful in this initial pyrolysis step may be effected by any of the heating means available to the skilled artisan.

A wide range of furnaces can be utilized for the initial pyrolysis. For small scale projects (e.g., research) small tube furnaces such as those made by Lindbergh Company may be used. These furnaces can be used with positive pressure and/or inert gas flow, through either quartz or glass tubing. Pot furnaces, such as those made by Harper Company, may also be used herein. Such furnaces are generally electrically heated.

For slightly larger scale work, standard box furnaces can be used. In furnaces of this type, a closed chamber, generally metal, is placed in the furnace and the starting material is placed in the chamber. Such chambers can be designed to withstand pressure, they can be welded closed for oxidation protection, they can include an interlocking 2 piece box with a porous sand, coke, or ceramic seal, or they can be equipped with a metal sleeve extending out the front of the furnace.

In preferred production procedures, a two piece interlocking box can be used. Where additional atmosphere control is desired, inert gas lines can be added to the chamber. The preferred design for small scale development is a sealed chamber having a positive inert gas pressure (e.g., 1–5 inches of water back pressure) and a gas vent line. Suitable furnaces for this work can be obtained from commercial suppliers such as Blue-M, Hot Pack, Sentry, or other suppliers. These furnaces are generally electrically heated and should be equipped with heat rate controllers such as those supplied by Omega.

For larger scale e.g., pilot plant operations, pot or pit furnaces can be used. These furnaces can be electrically heated, such as those supplied by General Electric, or they can be gas fired. In larger scale furnaces, a 2 piece construction, with a sand or coke seal is preferred.

In the production of carbon from cellulosic materials by the preferred method of the present invention, large scale furnaces designed for baking carbon and graphite electrode stock can be employed.

Following the initial pyrolysis, the pyrolysis atmosphere is preferably maintained over the material until it has cooled to a temperature of less than about 30°, preferably less than about 25° C. This prevents the potential spontaneous combustion of the otherwise hot pyrolyzed mass upon exposure to air.

The preferred process of the present invention also involves a size reduction step wherein pyrolyzed material is ground first into small particles (diameter about 2 mm or less) and ultimately into a fine powder (average particle size less than about 10 microns).

The formation of a powder from the pyrolyzed cellulosic material may be accomplished on any of a wide variety of grinding or milling devices. Generally the grinding/milling operation is conducted for a sufficient time, and with one or more appropriate apparatus, to produce a fine powder, i.e., a powder having a particle size of less than about 50 microns, preferably less than about 10 microns. Preferably, such grinding is accomplished in a series of progressively finer grinding apparatus.

For example, in preparing the preferred powder, the initial grinding may be a coarse grinding, conducted with a hammer mill or a Wiley Mill. This provides material of about −10 mesh. This coarse material is then subjected to additional grinding using an energy mill and/or an Attritor mill. The energy mill forms materials of a relatively uniform small particle size, about 10 microns. Attritor mills typically produce small particles over a broader range of particle sizes, i.e., from about 0.1 to 15 microns. A mixture of these fine powders may be used to produce the preferred fuel elements of the present invention.

The preferred process of the present invention also involves a second pyrolysis or "polishing" step, wherein the carbonized particulate material, or preferably the carbonized fine powder material, is again pyrolyzed in a non-oxidizing atmosphere, preferably in an inert gas stream, at a temperature between about 650° C. to about 1250°C. Temperatures between about 650° C. and 850° C. may be used to remove undesirable volatiles and other contaminants not removed during the initial pyrolysis or like contaminants which may be introduced during handling. The presence of such contaminants could adversely effect the quality of the smoke aerosol ultimately produced, by introducing off-tastes, and the like. Higher temperatures, e.g., 850° C. to 1250° C., may be used to reduce the surface area of the carbon, which tends to reduce the overall combustion temperature of the resulting fuel elements.

The polishing step is intended to assure maximum quality of the final product, as the bulk furnaces used for the initial pyrolysis step do not generally assure a product of sufficient quality and uniformity to meet the purity requirements for preferred fuel elements. In addition, the polishing step may be employed to adjust the physical and chemical parameters of the carbon. For example, the surface area of hardwood paper carbons can be controlled over a range of about 500 $m^2/g$ to less than about 50 $m^2/g$ (as measured by the nitrogen porosimetry method). The skeleton density (as measured by helium pictometer) can be varied between about 1.4 g/cc to about 2.0 g/cc. Noncarbon constituents such as sulfur and chlorine can be also be reduced by this polishing treatment. Finally, any remaining organic contaminants are pyrolyzed during this polishing step.

The furnaces used for polishing preferably have an inert flush gas or vacuum to sweep away contaminants such as hydrogen sulfide. The flushing characteristic is a desired feature but is not a required feature.

The furnaces and chamber designs for polishing are similar to those used in pyrolyzing. Suitable polishing furnaces include belt furnaces in which a continuous belt carries the carbon through a metal tunnel and the carbon is protected from oxidation by a nitrogen atmosphere. C. I. Hayes, Electric Furnace, Trent and others, make such furnaces. Another furnace type which might make a superior product is the fluidized bed furnace. If batch type furnaces are employed for the polishing step, residence times of several hours are normally required to ensure that the entire load has reached the polishing temperature. If fluidized bed type furnaces are employed, the residence time of the material being polished may be as little as a few minutes.

If this polishing step is not conducted, the maximum temperature of the initial pyrolysis step may be increased, e.g., up to about 1250° C., to achieve the modification of the combustion temperature of the resulting fuel elements, if desired.

Whether or not a polishing step is employed herein, the preferred carbon powder, prior to blending with other additives or ingredients, should have the following characteristics:

Hydrogen/ Oxygen content—the hydrogen and oxygen content of the carbon used in preparing fuel elements for preferred smoking articles should each be less than about 3 weight percent, preferably less than 2 weight percent, and most preferably less than about 1 weight percent, as determined on a Perkin Elmer Model 240 C Elemental Analyzer. Hydrogen and oxygen levels of this type indicate that the material is predominantly carbon, and that upon burning, primarily carbon oxidation products, i.e., CO and $CO_2$, will be given off. Products having a higher hydrogen and/or oxygen content could contribute significant pyrolysis products to the mainstream combustion gases, which could contribute off tastes to the aerosol delivered to the user of preferred smoking articles.

Surface Area—the surface area of the carbon used in preparing fuel elements for preferred smoking articles should be at least about 200 $m^2/g$, preferably at least about 250 $m^2/g$, and most preferably at least about 300 $m^2/g$, as measured by nitrogen porosimetry. Carbon fuel elements prepared from carbon having the indicated surface areas are easy to light.

Carbon content—the carbon content of the carbon powder used in preparing fuel elements for preferred smoking articles should be greater than about 90 weight percent, preferably greater than about 94 weight percent, and most preferably greater than about 96 weight percent, as determined on a Perkin Elmer Model 240 C Elemental Analyzer. High carbon levels are preferred because upon burning, virtually only carbon oxidation products, i.e., CO and $CO_2$ will be given off.

Skeleton density—The skeleton density of the carbon powder used to prepare fuel elements for preferred smoking articles should range from about 1.4 g/cc to about 2.0 g/cc, preferably about 1.8 g/cc to about 2.0 g/cc, as measured by helium pictometer. Carbon having a skeleton density of this type provides a fuel element which will readily support combustion.

Ash content—The ash content of the carbon powder should be less than about 5 weight percent, preferably less than about 3 weight percent, and most preferably less than about 1 weight percent. Ash is generally determined by burning a fuel element prepared from a given quantity of carbon powder, binder (SCMC) and additives, and weighing the resulting ash.

Volatiles content—The volatiles content of the carbon powder should be less than about 4 weight percent, preferably less than about 2 weight percent. The presence of large amounts of volatiles can lead to off-tastes in the mainstream combustion products. The volatiles content is generally determined by (1) drying and weighing the carbon powder sample; (2) heating the sample to 750° C. under an inert atmosphere for 30 minutes; (3) cooling the sample to room temperature in a desiccator; (4) weighing the cooled sample and calculating the percentage of volatiles.

The resulting pyrolyzed carbon powder is preferably admixed with a binder, water, and additional ingredients (as desired) and shaped or formed into the desired fuel element using extrusion or pressure forming techniques.

The carbon content of these final fuel elements is preferably at least about 60% to 70%, most preferably about 80% or more, by weight. High carbon content fuel elements are preferred because they produce minimal pyrolysis and incomplete combustion products, little or no visible sidestream smoke, and minimal ash, and have high heat capacity.

The binders which may be used in preparing such fuel elements are well known in the art. A preferred binder is sodium carboxymethylcellulose (SCMC), which may be used alone, which is preferred, or in conjunction with materials such as sodium chloride, vermiculite, bentonite, calcium carbonate, and the like. Other useful binders include gums, such as guar gum, other cellulose derivatives, such as methylcellulose and carboxymethylcellulose (CMC), hydroxypropyl cellulose, starches, alginates, and polyvinyl alcohols.

A wide range of binder concentrations can be utilized. Preferably, the amount of binder is limited to minimize contribution of the binder to undesirable combustion products which would affect the taste of the aerosol. On the other hand, sufficient binder should be included to hold the fuel element together during manufacture and use. Generally, the carbon/binder admixture is prepared such that a stiff, dough-like consistency is achieved. The term, "stiff, dough-like" refers to the propensity of the admixture to retain its shape, i.e., at room temperature, a ball of the admixture will show only a very slight tendency to flow over a 24 hour period.

The fuel elements of the present invention also may contain one or more additives to improve burning, such as up to about 5 weight percent of sodium chloride to improve smoldering characteristics and as a glow retardant. Also, up to about 5, preferably from about 1 to 2, weight percent of potassium carbonate may be included to control flammability. Additives to improve physical characteristics, such as clays like kaolins, serpentines, attapulgites and the like also may be used.

The preferred fuel elements of the present invention are substantially free of volatile organic material. By that, it is meant that the fuel element is not purposely impregnated or mixed with substantial amounts of volatile organic materials, such as volatile aerosol forming or flavoring agents, which could degrade in the burning fuel. However, small amounts of materials, e.g., water, which are naturally adsorbed by the carbon in the fuel element, may be present therein.

In certain embodiments, the fuel element may purposely contain minor amounts of tobacco, tobacco extracts, and/or other materials, primarily to add flavor to the aerosol. Amounts of these additives may range up to about 25, preferably at about 10 to 20, weight percent, depending upon the additive, the fuel element, and the desired burning characteristics.

In one preferred embodiment, an extruded carbon containing fuel is prepared by admixing from about 50 to 99 weight percent, preferably about 80 to 95 weight percent, of the pyrolyzed carbon powder, with from about 1 to 50 weight percent, preferably about 5 to 20 weight percent of the binder, with sufficient water to make an extrudable paste, i.e., a paste having a stiff dough-like consistency.

The amount of water added to the pyrolyzed material and the binder will vary to some extent upon the binder being used, but is generally from about 1 to 5, preferably 2 to 3, parts of water per part of pyrolyzed material will be sufficient to produce a formable paste. Preferably, the dough is provided in flowable form, i.e., granular or pellets, for ease in feeding of the material to the forming device. The dough is then formed, for example by using a standard ram or piston type extruder, into the desired shape, with the desired number and configuration of passageways. The formed fuel element is then dried, preferably at from about 20° C. to 95° C. to reduce the final moisture content to less than about 4, preferably less than about 2 percent by weight.

In another embodiment, the carbon paste is subjected to a size reduction step prior to being formed into the final desired shape. In this embodiment the paste formed as described above is dried to reduce the moisture content to about 5 to 10 weight percent. The dried paste is then ground to a particle size of less than about 20 mesh size. This ground material is treated with water to raise the moisture level to about 30 weight percent, and the resulting stiff, dough-like paste is fed to a forming means, such as a conventional pill press, wherein a die punch pressure of from 455 kg (1,000 pounds) to 4550 kg (10,000 pounds), preferably about 2273 kg (5,000 pounds), of load is applied to create a pressed pellet having the desired dimensions. This pressed pellet is then preferably dried at from about 55° C. to about 100° C. to reduce the moisture content to between 5 to 10 weight percent.

In another preferred embodiment, a high quality fuel element may be formed by casting a thin slurry or flowable paste of the carbon/binder mixture (with or without additional components) into a sheet, drying the sheet, regrinding the dried sheet into a powder, forming a stiff paste with water, and extruding the paste as described above. Treatment such as this ensures an even distribution of the binder with the carbon particles. In general, the carbon powder is ground to a particle size of less than about 5 to 10 microns and mixed with a binder, such as sodium carboxymethylcellulose and sufficient water to make a flowable paste. The paste is cast into a sheet of about 1.6 mm (0.0625 in.) thickness. The sheet is then dried and pulverized to a final particle size of less than about 100 mesh. The moisture level is then raised to between 25 to 30 weight percent by the addition of water and the mixture is then shaped into fuel elements by either extrusion or pressure forming means.

If desired, fuel elements containing carbon and binder may be further pyrolyzed in a non-oxidizing atmosphere after formation, for example, at from about 450° C. to 1050° C., preferably at from about 850° C. to 950° C., for about two hours, to convert the binder to carbon and thereby form a substantially all carbon fuel element. This step reduces any taste contributions which the binder may contribute to the mainstream aerosol.

It has also been discovered that by heating the formed fuel element at above about 1000° C., the CO delivery may be reduced. Without wishing to be bound by theory, it is believed that this CO reduction results from changes in the carbon structure which in turn cause a decrease in the combustion temperature of the fuel element.

Fuel elements prepared in accordance with the present invention are especially useful in preparing smoking articles of the type described in European Patent Publication No. 174,645. These articles generally include (1) the fuel element; (2) a physically separate aerosol generating means including an aerosol forming material, which is attached to one end of said fuel element; and (3) an aerosol delivery means such as a longitudinal passageway in the form of a mouthend piece, which is attached to said aerosol generating means.

Preferred fuel elements prepared in accordance with the methods of the present invention are from about 5 to 15 mm, more preferably, from about 8 to 12 mm in length, and from about 2 to 8, preferably about 4 to 6 mm in diameter. Preferably, the apparent bulk density is greater than 0.7 g/cc as measured by mercury intrusion. In preferred cigarette-type smoking articles, fuel elements having these characteristics are sufficient to provide fuel for at least about 7 to 10 puffs, i.e., the normal number of puffs generally obtained by smoking a conventional cigarette under FTC smoking conditions (one 35 cc puff of 2 seconds duration every 60 seconds).

Preferably, the fuel element prepared by the process of the present invention is provided with one or more longitudinally extending passageways. These passageways help to control transfer of heat from the fuel element to the aerosol generating means, which is important both in terms of transferring enough heat to produce sufficient aerosol and in terms of avoiding the transfer of so much heat that the aerosol former is degraded.

Generally, such passageways provide porosity and increase early heat transfer to the aerosol generating means by increasing the amount of hot gases delivered thereto. The passageways also tend to increase the rate of burning of the fuel element, and aid in the lighting thereof. The longitudinal passage or passages, if desired, may be drilled using conventional techniques, or they may be formed at the time of pressing. In most instances, the carbon containing fuel elements should be capable of being ignited by a conventional cigarette lighter without the use of any oxidizing agents.

The preparation and use of the preferred fuel elements of the present invention will be illustrated by reference to the Figures which accompany the present disclosure.

Figure 2:
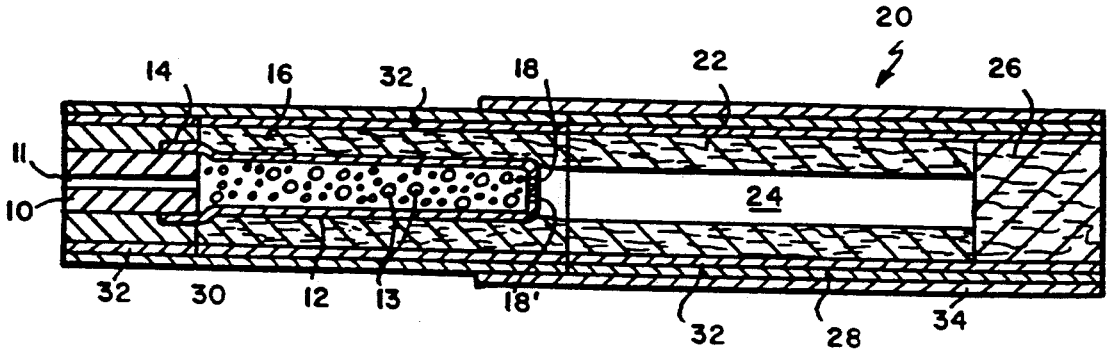
FIG. 2 is a longitudinal view of one preferred smoking article which may employ a carbon containing fuel element prepared by the method of the present invention.
Figure 2A:
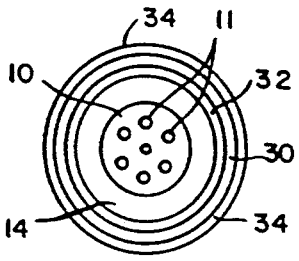
FIGS. 2A-2C are sectional views of fuel element passageway configurations useful in the preferred smoking articles.
Figure 2B:
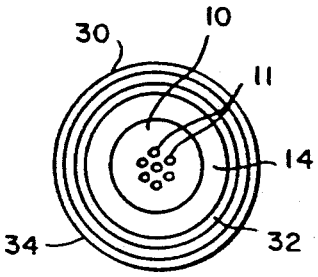
Figure 2C:
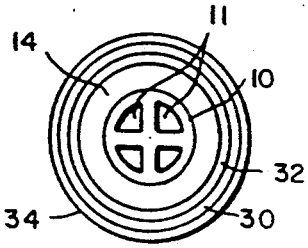

FIG. 2 illustrates a cigarette-type smoking article which utilizes the carbon containing fuel element prepared by the method of the present invention. The illustrated cigarette-type smoking article is approximately the same size as a conventional cigarette, i.e., about 7 to 8 mm in diameter and about 80 mm in length. FIGS. 2A-2C illustrate different arrangements of fuel element passageways 11 which are useful in such smoking articles.

Overlapping the mouth end of the fuel element 10 is a metallic capsule 12, which contains a substrate material 13 including one or more aerosol forming substances (e.g. polyhydric alcohols such as glycerin or propylene glycol). The periphery of fuel element 10 in this article is surrounded by a resilient jacket of insulating fibers 14, such as glass fibers, and capsule 12 is surrounded by a jacket of tobacco 16. Two slit-like passageways 18 and 18' are provided at the mouth end of the capsule in the center of the crimped tube.

At the mouth end of tobacco jacket 16 is situated a mouthend piece 20 comprising a cellulose acetate cylinder 22 which provides aerosol passageway 24, and a low efficiency cellulose acetate filter piece 26. The article, or portions thereof, is overwrapped with one or more layers of cigarette papers 28, 30, 32, and 34.

Upon lighting the aforesaid smoking article, the fuel element 10 burns, generating the heat used to volatilize the aerosol forming substance or substances in the aerosol generating means 12. Thus there is generated a smoke-like aerosol which passes out of capsule 12 through holes 18 and 18', through passageway 24, and through filter piece 26, to the user.

Because of the small size and burning characteristics of the fuel elements of the present invention, the fuel element usually begins to burn over substantially all of its exposed surface area within a few puffs. Thus, that portion of the fuel element adjacent to the aerosol generator becomes hot quickly, which significantly increases heat transfer to the aerosol generator, especially during the early and middle puffs.

The aerosol delivered produced by the preferred articles of this invention is measured as wet total particulate matter (WTPM). This WTPM has no mutagenic activity as measured by the Ames test, i.e., there is no significant dose response relationship between the WTPM produced by preferred articles of the present invention and the number of revertants occurring in standard test microorganisms exposed to such products. According to the proponents of the Ames test, a significant dose dependent response indicates the presence of mutagenic materials in the products tested. See Ames et al., *Mut. Res.*, 31: 347-364 (1975); NAGAO et al., *Mut. Res.*, 42: 335 (1977).

The preparation of the carbon containing fuel elements of the present invention will be further illustrated with reference to the following examples which will aid in the understanding of the present invention, but which are not to be construed as limitations thereof. All percentages reported herein, unless otherwise specified, are percent by weight. All temperatures are expressed in degrees Celsius and are uncorrected.

EXAMPLE 1

Step A: Initial Pyrolysis

Carbon was prepared from a non-talc containing grade of Grande Prairie Canadian Kraft Paper made from hardwood and obtained from Buckeye Cellulose Corp., Memphis, Tenn. This paper had the following characteristics, when analyzed as described hereinabove:

| | |
|---|---|
| moisture | 10%; |
| ash | 0.15%; |
| carbon | 41%; and |
| hydrogen | 6% |

A large batch of this kraft paper (3000 pounds) was pyrolyzed in an electric pot furnace made by General Electric. The paper was placed in stainless steel cans approximately 32 inches in diameter with a cap and a sand seal. No inert gas was used.

The furnace was fired on a heat rate schedule of 15° C./hr to 550° C. and was held at 550° C. for 8 hours. No attempt was made to measure the internal temperature of the paper.

Approximately 1000 pounds of carbon was produced which, when analyzed in accordance with the methods described hereinabove, had the following properties:

| | |
|---|---|
| Hydrogen | 3.3% |
| Oxygen | 3.5% |
| Surface area | 181 $m^2/g$ |
| Carbon | 88.7% |
| Skeleton Density | 1.4 g/cc |
| Nitrogen | Not detected |

This carbon was not considered to be suitable for use in smoking devices because of decomposition products which could potentially cause taste problems.

Step B Size Reduction

The carbon from Step A was ground in a Wiley mill, (Arthur H. Thomas Co., Philadelphia, Pa.), to reduce the carbon to a coarse powder (−10 mesh), and then further ground in a Trost mill (Garlock Co., Newton, Pa.) to a very fine powder, i.e., a powder having an average particle size of less than about 10 microns.

Step C: Polishing

The powder from Step B was placed in a 9 inch diameter stainless steel container and was repyrolyzed (i.e., polished) in the furnace of Example 6. The steel container was positioned in the furnace, and a positive flow of nitrogen was provided as in Example 6, Step A. The furnace was rushed to the final polishing temperature of 850° C. (at a heating rate of approximately 150° C./hr) and held at that final temperature for 8 hours. The polished material was then cooled to room temperature under nitrogen. The resulting polished carbon had the following properties when analyzed as described hereinabove:

| | |
|---|---|
| Hydrogen | 0.5% |
| Carbon | 95% |
| Skeleton Density | 1.99 g/cc |
| Moisture | 0.7% |
| pH | 7.95 |

Step D: Mixing and Forming

The polished powder of Step C was made into an extrudable mix by blending 378.25 g of the carbon with 42.5 grams of sodium carboxymethylcellulose (Hercules, Wilmington, Del.) in a Sigma Blade Mixer (Read Corporation, 1 quart capacity) for 10 minutes. 240 grams of water containing 4.25 grams of potassium carbonate, dissolved therein was added to the mixer. After blending for about 5 minutes the lid was placed on the mixer and the mix was allowed to blend until a consistent putty-like mass was formed. The mixing time was about 3 hours. The lid was removed and the mix was allowed to air dry while mixing was continued, i.e., until the large putty like mass started breaking down into small balls about ½ inch diameter. This required about 30 minutes. The moisture content of the mix at this point was about 36%. The small balls (about 0.5 in. diameter) were allowed to age in a plastic bag for about 1 hour.

The above mix was extruded using a piston type extruder having a piston size of 1 ¾×9". The small balls of carbon/binder were pushed into the piston and tamped-in with a brass rod to remove air pockets. Approximately 150 grams of mix was used per extrusion. A plastic type extrusion die (streamline flow pattern) was used to produce a solid rod 4.5 mm (0.177 inch) in diameter. The extrusion was conducted in a vertical position on a Fornex LT30D, (Forney Co., Wampum, Pa.), tensile tester. The extrusion rate was 0.7 inches/minute on the ram and the pressure was 3000 PSI.

The extrudate was allowed to dry overnight at 75° C. in 60% humidity. It was then dried to a 4% moisture level at 65° C. in a forced air oven. The rod was then cut into 10 mm lengths, and holes (0.66 mm) were drilled longitudinally through the rod segments.

EXAMPLE 2

Fuel sources of the type prepared in Example 1 were pyrolyzed after formation in a flowing nitrogen gas stream using a Lindeburg tube furnace (Lindeburg, Model S4031, Watertown, Wis.). This pyrolysis was conducted to convert the binder material in the fuel element to carbon.

A Vycor tube was placed in the furnace, nitrogen gas was admitted at one end of the tube, passing through the tube and out the other end through a second tube immersed in water creating a 1" of water back pressure in the Vycor tube.

Fuel sources were placed in the hot zone while the furnace was cold, the furnace flushed with nitrogen for 15 minutes with a flow of 100 cc/hr and then heated to 1050° C. in approximately 30 minutes.

The furnace was held at the pyrolysis temperature for one hour and was then allowed to cool to room temperature.

EXAMPLES 3-5

To determine the effect of polishing conditions on the properties of the polished carbon, the powder produced in Example 1, Step B was treated at different polishing temperatures. In the following examples, the carbon powder sample was polished for 2 hours at the indicated temperature. The modifications in the chemical and physical properties of the carbon are indicated following the polishing temperature.

| EXAMPLE No. | Polish Temp. °C. | Skeleton Density | Surface Area ($m^2/g$) |
|---|---|---|---|
| 3 | 750 | 1.82 | 480 |
| 4 | 950 | 1.95 | 270 |
| 5 | 1150 | 1.92 | 20 |

EXAMPLE 6

Step A: One-Step Pyrolysis

A stack (4.2 kg) of the paper used in Example 1 was pyrolyzed in a Blue M box-type furnace with a 10×10×8 inch opening. A metal box (304 Stainless Steel) measuring 9×9×28 inch was inserted into the box furnace and a face cover was bolted onto the outer face of the metal box (the portion not in the furnace). The space around the insert was packed with a ceramic fiber insulating material.

Nitrogen gas was fed into the box through the face cover at a rate of about 36 liters per hour. A gas outlet was provided at the top of the box and inserted into a water bath causing a back pressure of 2 inches of water in the metal box.

A temperature control thermocouple was placed inside the furnace but outside the metal insert. The furnace was heated on the following schedule:

1. Heat from 50°-350° C. in 20 hours (at 15° C./hr);
2. Hold for 2 hours at 350° C.;
3. Heat from 350°-650° in 20 hours (at 15° C./hr);
4. Hold for 2 hours at 650° C.;
5. Heat from 650° C.-800° C. in 17 hours (at 9° C./hr);
6. Hold for 13 hours at 850° C.;
7. Cool furnace (2 days to room temperature).

To assure that the paper inside the insert was heated to the desired temperature, a thermocouple was placed in the core of the paper stack. The thermocouple in the paper indicated that the paper was heated to 850° for 7 ½ hours. 0.98 Kilograms of carbon was produced. The carbon produced in this example was ground to a coarse powder which, when subjected to the analysis scheme set forth hereinabove, had the following properties:

| | |
|---|---|
| Hydrogen | 0.6% |
| Surface area | 275 $m^2/g$ |
| Ash | 0.48% |
| Carbon | 96% |
| Density | 1.92 g/cc |
| Nitrogen | not detected |
| pH | 10.71 |

Step B: Fuel Element Formation

Nine parts (by weight) of the carbon powder of Step A was mixed with one part of SCMC powder, $K_2CO_3$ was added at 1 wt. percent, and water was added to make a thin slurry, which was then cast into a thin (ca. 2 mm thick) sheet and dried at room temperature for 48 hours.

The dried sheet was then reground on a Wiley mill to a coarse powder (−10 mesh) and sufficient water was added to make a stiff, dough-like paste. This paste was then loaded into a room temperature batch extruder. The female extrusion die for shaping the extrudate had tapered surfaces to facilitate smooth flow of the plastic mass. A low pressure (less than 5 tons per square inch or $7.03\times10^6$ kg per square meter) was applied to the plastic mass to force it through a female die of 4.6 mm diameter.

The wet rod was then allowed to dry at room temperature overnight. To assure that the rod was completely dry it was then placed into an oven at 80° C. for two hours. This dried rod had an apparent (bulk) density of about 0.9 g/cc (as measured by mercury intrusion), a diameter of 4.5 mm, and an out of roundness of approximately 3%.

The dry, extruded rod was cut into fuel elements of 10 mm length and seven passageways (each 0.6 mm in diameter) were drilled through the length of the rod, substantially as illustrated in FIG. 2A.

EXAMPLE 7

In a method similar to that of Example 6B, activated carbon powder (Calgon PCB-G) having an average particle size of about 5-10 microns, an ash content of about 2.079% and a sulfur content of about 0.7% was admixed with SCMC binder (Hercules Corp. Grade 7H-F) in a ratio of 9 parts carbon, 1 part binder. Sufficient water was added to the mixture to form a thick slurry which would spread into a sheet.

The thick slurry was cast onto a section of polyethylene film at about 1.5 mm (1/16 in.) thick, and air dried over 24 hours.

The resulting hard, sheet-like flakes were collected from the plastic sheet and ground on a Wiley Mill to a powder. The powder was further pulverized by grinding with a mortar & pestle, to a final particle size of less than about 100 mesh. The moisture content of the powder carbon was about 10 percent at this stage.

The moisture content was raised to between about 25-30 weight percent by spraying a mist of water over the carbon powder with mixing, thus ensuring that the entire powder was evenly treated with moisture. At a moisture content of 25-30 percent, this carbon/binder admixture was deemed a stiff, dough-like paste, suitable for extrusion or pressing into fuel elements.

In the present example, this admixture was pressed at an applied load of about 2,273 kg (5,000 lbs.) in a hydraulic punch and die press, forming a fuel element about 5.5 mm in diameter, 10 mm in length, having one 0.5 mm diameter central passageway. The fuel element was dried in a hot air oven at about 200° F. for 2 hours, bringing the moisture level down to less than about 10 percent.

EXAMPLE 8

Cigarette-type smoking articles, substantially as illustrated in FIG. 2, were prepared as follows:

The fuel element, 10 mm long, 4.5 mm in diameter, was prepared as in Examples 1, 2, and 6.

The macrocapsule was prepared from drawn aluminum tubing, about 30 mm in length, having an outer diameter of about 4.5 mm. The rear 2 mm of the capsule was crimped to seal the mouth end of the capsule. In the sealed mouth end of the capsule, two slits ($0.1 \times 1$ mm) were cut to allow passage of the aerosol materials into the mouthend piece.

The aerosol former used in this example was prepared as follows:

Tobacco was ground to a medium dust and extracted with water in a stainless steel tank at a concentration of from about 1 to 1.5 pounds of tobacco per gallon of water. The extraction was conducted at ambient temperature using mechanical agitation for from about 1 hour to about 3 hours. The admixture was centrifuged to remove suspended solids and the aqueous extract was spray dried by continuously pumping the aqueous solution to a conventional spray dryer, such as an Anhydro Size No. 1, at an inlet temperature of from about 215°-230° C. and collecting the dried powder material at the outlet of the drier. The outlet temperature varied from about 82°-90° C.

High surface area alumina (surface area = 280 $m^2/g$) from W. R. Grace & Co. (designated SMR-14-1896), having a mesh size of from −8 to +20 (U.S.) was sintered at a soak temperature above about 1400° C., preferably from about 1400° to 1550° C., for about one hour and cooled. The alumina was washed with water and dried.

The alumina (640 mg) was treated with an aqueous solution containing 107 mg of spray dried flue cured tobacco extract and dried to a moisture content of less than about 3.5 weight percent. This material was then treated with a mixture of 233 mg of glycerin and 17 mg of a flavor component obtained from Firmenich, Geneva, Switzerland, under the designation T69-22.

The macrocapsule was filled with about 200 mg of this treated alumina.

The fuel element was inserted into the open end of the filled macrocapsule to a depth of about 3 mm. The fuel element - macrocapsule combination was overwrapped at the fuel element end with a 10 mm long, glass fiber jacket of Owens-Corning 6432 (having a softening point of about 640° C.), with 3 wt. percent pectin binder, to a diameter of about 8 mm and overwrapped with Ecusta 646 plug wrap.

An 8 mm diameter tobacco rod (28 mm long) with an Ecusta 646 plug wrap overwrap was modified to have a longitudinal passageway (about 4.5 mm diameter) therein. The jacketed fuel element - macrocapsule combination was inserted into the tobacco rod passageway until the glass fiber jacket abutted the tobacco. The glass fiber and tobacco sections were overwrapped with Kimberly-Clark P 878-5 paper.

A cellulose acetate mouthend piece (30 mm long), overwrapped with Ecusta 646 plug wrap and joined to a filter element (10 mm long) having an overwrap of Ecusta 646 plug wrap, by K-C's P 878-16-12 paper. This mouthend piece section was joined to the jacketed fuel element - macrocapsule section by tipping paper.

The present invention has been described in detail, including the preferred embodiments thereof. However, it will be appreciated that those skilled in the art, upon consideration of the present disclosure, may make modifications and/or improvements on this invention and still be within the scope and spirit of this invention as set forth in the following claims.

What is claimed is:

1. A method of producing a carbon fuel for smoking articles, comprising the steps of:

(a) pyrolyzing a carbon containing starting material at a temperature range between about 400° and 1250° C. in a non-oxidizing atmosphere;

(b) cooling the pyrolyzed material in a non-oxidizing atmosphere;

(c) reducing the size of the pyrolyzed material; and (d) reheating the reduced material in a non-oxidizing atmosphere at a temperature of at least 650° C. for a period sufficient to remove volatiles therefrom.

2. The method of claim 1, wherein the reheating step is conducted at a temperature of from about 750° C. to 850° C.

3. The method of claim 1 or 2, wherein the initial pyrolysis step is conducted at a temperature of from about 500° C. to 900° C.

4. The method of claim 1 or 2, further comprising:

admixing the reheated material with sufficient binder and water to make a formable paste;

forming the paste into a fuel element; and drying the fuel element.

5. A method of producing a carbon fuel for smoking articles, comprising the steps of:

(a) reducing the size of pyrolyzed carbon containing material to an average particle size of about 10 microns or less;

(b) admixing the particulate carbon material with sufficient binder and water to make a paste;

(c) forming the paste into a coherent mass;

(d) drying the coherent mass;

(e) reducing the size of the dried coherent mass into coarse particles; and (f) admixing the coarse particles with sufficient water to make a paste which is suitable for forming into fuel elements.

6. The method of claim 5, wherein steps (c), (d) and (e) further comprise the steps of:

creating a slurry of carbon, binder and water;

casting the slurry into a sheet;

drying the sheet; and reducing the sheet to flowable granules.

7. The method of claim 1 or 5, wherein the carbon containing starting material is a cellulosic material with a high alpha-cellulose content.

8. The method of claim 7, wherein the cellulosic material is a hardwood paper pulp.

9. The carbon prepared by the process of claim 1 or 2, having the following physical properties:

hydrogen content below about 3% oxygen content below about 3% surface area greater than about 200 $m^2/g$ ash content less than about 5%.

10. The carbon of claim 9, which has the following physical properties:

hydrogen content below about 1% oxygen content below about 1% surface area greater than about 300 $m^2/g$ ash content less than about 1%.

11. A fuel element prepared by admixing the carbon of claim 9 with binder and water, forming the fuel element using extrusion or pressure forming apparatus, and drying.

12. The carbon fuel element prepared by the process of claim 4.

13. The method of claim 1, 2, or 3, further comprising the steps of:

(a) forming a fuel element from a mixture comprising carbon and a binder; and (b) pyrolyzing the formed fuel element in a non-oxidizing atmosphere to convert at least a portion of the binder to carbon.

14. The method of claim 13, wherein the pyrolysis is conducted at a temperature range of from about 450° C. to about 1050° C.

15. The method of claim 13, wherein the pyrolysis is conducted at a temperature range of from about 850° C. to about 950° C.

16. The method of claim 13, wherein the binder is a cellulose derivative.

17. The method of claim 14, wherein the binder is sodium carboxymethylcellulose.

18. The method of claim 5 or 6, further comprising the steps of:

(a) forming a fuel element from a mixture comprising carbon and a binder; and (b) pyrolyzing the formed fuel element in a non-oxidizing atmosphere to convert at least a portion of the binder to carbon.

19. The method of claim 18, wherein the pyrolysis is conducted at a temperature range of from about 450° C. to about 1050° C.

20. The method of claim 18, wherein the pyrolysis is conducted at a temperature range of from about 850° C. to about 950° C.

21. A method of preparing a fuel element for a smoking article comprising the steps of:

(a) forming a fuel element from a mixture comprising carbon and a binder selected from the group consisting of cellulose derivatives, gums, starches, alginates, and polyvinyl alcohols; and (b) pyrolyzing the formed fuel element in a non-oxidizing atmosphere to convert at least a portion of the binder to carbon.

22. The method of claim 21, wherein the pyrolysis is conducted at a temperature range of from about 450° C. to about 1050° C.

23. The method of claim 21, wherein the pyrolysis is conducted at a temperature range of from about 850° C. to about 950° C.

24. The method of claim 21, 22, or 23, wherein the binder is a cellulose derivative.

25. The method of claims 21, 22, or 23, wherein the binder is sodium carboxymethylcellulose.

26. The method of claim 21, 22, or 23, wherein the carbon used to form the fuel element has the following physical properties:

hydrogen content below about 3%
oxygen content below about 3%
surface area greater than about 200 $m^2/g$
ash content less than about 5%.

27. The method of claim 21, 22, or 23, wherein the carbon used to form the fuel element has the following physical properties:

hydrogen content below about 1%
oxygen content below about 1%
surface area greater than about 300 $m^2/g$
ash content less than about 1%.

28. The method of claim 26, wherein the binder is a cellulose based derivative.

29. A fuel element for a smoking article prepared by the method of claim 21, 22, or 23.

30. The fuel element of claim 29, having a length prior to smoking within the range of about 5 to about 15 mm.

31. The fuel element of claim 29, having a diameter within the range of about 2 to about 8 mm.

32. The fuel element of claim 30, having a plurality of longitudinal passageways.

* * * * *